US009249572B2

(12) United States Patent
Neumayr

(10) Patent No.: US 9,249,572 B2
(45) Date of Patent: Feb. 2, 2016

(54) PREFABRICATED SHEAR WALL SYSTEM WITH INTEGRATED CHANNELS

(76) Inventor: Michael Neumayr, Los Angeles, CA (US)

( * ) Notice: Subject to any disclaimer, the term of this patent is extended or adjusted under 35 U.S.C. 154(b) by 907 days.

(21) Appl. No.: 12/901,700

(22) Filed: Oct. 11, 2010

(65) Prior Publication Data

US 2012/0085062 A1 Apr. 12, 2012

(51) Int. Cl.
*E04C 2/34* (2006.01)
*E04C 2/32* (2006.01)

(52) U.S. Cl.
CPC ..... *E04C 2/3405* (2013.01); *E04C 2/322* (2013.01); *E04C 2/324* (2013.01); *E04C 2002/3455* (2013.01)

(58) Field of Classification Search
CPC ..... E04C 2/3405; E04C 2002/3455; E04C 2002/3444; E04C 2/324; E04C 2/322
USPC ..... 52/264, 267, 265, 270, 783.1, 783.11, 52/783.17, 793.18, 783.19, 798.1, 220.1, 52/220.2, 220.4, 582.1, 586.1, 586.2
See application file for complete search history.

(56) References Cited

U.S. PATENT DOCUMENTS 2,034,489 A * 3/1936 Scherer ..... 52/405.4
2,039,601 A * 5/1936 London ..... 52/479
2,065,433 A * 12/1936 Dercum et al. ..... 52/272
3,024,879 A * 3/1962 Kandra ..... 52/783.1
3,235,920 A * 2/1966 Davis ..... 52/586.1
3,321,826 A * 5/1967 Lowy ..... 29/423
3,353,315 A 11/1967 Barker
3,975,882 A * 8/1976 Walter ..... 52/571
4,037,379 A * 7/1977 Ozanne ..... 52/404.3
4,333,280 A 6/1982 Morton
4,580,379 A * 4/1986 Nusbaum ..... 174/482
4,832,308 A * 5/1989 Slonimsky et al. ..... 249/78
5,440,846 A 8/1995 Record
5,543,204 A * 8/1996 Ray ..... 428/179
5,581,969 A 12/1996 Kelleher
5,600,928 A * 2/1997 Hess et al. ..... 52/309.4
5,617,686 A * 4/1997 Gallagher, Jr. ..... 52/309.12
5,791,118 A 8/1998 Jordan
6,085,485 A 7/2000 Murdock
6,205,725 B1 * 3/2001 Butler ..... 52/292
6,209,273 B1 * 4/2001 Jeffers et al. ..... 52/220.7
6,260,323 B1 * 7/2001 Hockey ..... 52/481.1
6,309,732 B1 10/2001 Lopez-Anido
6,412,243 B1 7/2002 Sutelan (Continued)

OTHER PUBLICATIONS

Deep-Draft Coastal Navigation Entrance Channel Practice [online], Zeki Demirbilek, Frank Sargent, US Army Corps of Engineers Coastal Engineering Technical Note I-63, Mar. 1999. Retrieved from the Internet: <URL: chl.erdc.usace.army.mil/library/publications/chetn/pdf/cetn-i-63.pdf>.

*Primary Examiner* — Adriana Figueroa
*Assistant Examiner* — Jessie Fonseca
(74) *Attorney, Agent, or Firm* — CreatiVenture Law, LLC; Dennis JM Donahue, III

(57) ABSTRACT

Prefabricated wall segments for construction of buildings. The prefabricated wall segments are lightweight and easy to install and enable an improved ability to install electrical, plumbing, heating and cooling systems as well as insulation in both the vertical and horizontal direction. The prefabricated wall segments can be utilized in new construction as well as in preexisting structures without the need for specialty equipment or tools.

23 Claims, 8 Drawing Sheets

(56) References Cited

U.S. PATENT DOCUMENTS

| | | | | |
|---|---|---|---|---|
| 6,571,523 | B2 * | 6/2003 | Chambers | 52/309.2 |
| 6,584,740 | B2 | 7/2003 | Record | |
| 6,591,567 | B2 | 7/2003 | Hota | |
| 6,848,233 | B1 * | 2/2005 | Haszler et al. | 52/783.17 |
| 7,127,865 | B2 | 10/2006 | Douglas | |
| 8,070,877 | B2 | 12/2011 | Freudiger | |
| 2002/0014051 | A1 | 2/2002 | Fraval | |
| 2002/0088199 | A1 * | 7/2002 | Linn | 52/745.19 |
| 2003/0041547 | A1 * | 3/2003 | Gosselin | 52/630 |
| 2004/0074206 | A1 * | 4/2004 | Tanase et al. | 52/783.17 |
| 2006/0096214 | A1 | 5/2006 | Groschup | |
| 2007/0051061 | A1 | 3/2007 | Weinmann | |
| 2008/0276553 | A1 * | 11/2008 | Ingjaldsdottir et al. | 52/184 |
| 2011/0099932 | A1 * | 5/2011 | Saulce | 52/426 |

* cited by examiner

ISOMETRIC VIEW OF CORRUGATED SHEAR WALL PANEL
(INTERIOR SHEATHING NOT SHOWN)

Alternative Wall Panel Cross Section V1. Corrugated Core, Version 1 & Outer Shear Panel Attached to Solid Composite Corrugated Core with Lap Joint Panel Connection

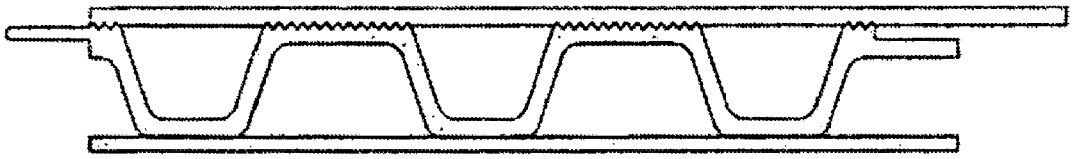

FIG. 5A

Alternative Wall Panel Cross Section V2. Corrugated Core, Version 2 Double Sided Corrugated Core, Outer & Inner Shear Panel Attached Separately

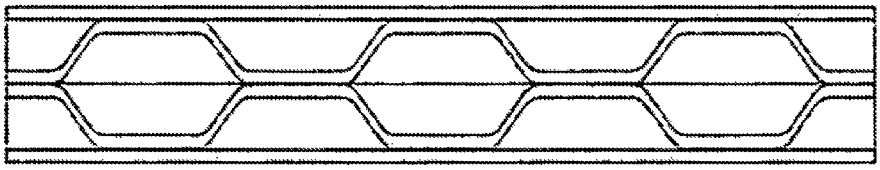

FIG. 5B

Alternative Wall Panel Cross Section V3. Corrugated Core, Version 3 with Channel Braces & Vertical Connector Channels, Outer & Inner Shear Panel Attached Separately

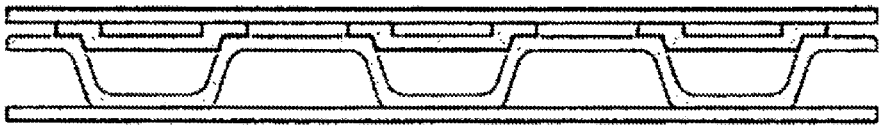

FIG. 5C

PREFABRICATED SHEAR WALL SYSTEM WITH INTEGRATED CHANNELS

FIELD

The field of art to which this invention relates pertains to prefabricated modular shear wall systems with integrated installation channels for electrical, plumbing, heating, ventilation and air conditioning (HVAC).

BACKGROUND

The statements in this background section merely provide background information related to the present disclosure and may not constitute prior art.

The invention relates to prefabricated modular building construction and units utilized in that construction. Prefabricated building components are used for construction because of their efficiency in installation which can potentially have expense cutting aspects and the reduction in the depletion of natural resources.

Historically the use of 2×4 studs of wood or other lumber of standard dimensions were most commonly used to fabricate the interior and exterior portions of buildings. Skilled tradesmen and a significant amount of time are needed for the fabrication of buildings by this traditional method of building construction. While prefabricated walls made from studs are available, the weight of the units makes them less efficient for installation. These prefabricated walls do not overcome the issue of the depletion of natural resources because they use standard lumber, the manufacturing of which involves a significant amount of waste material. Due to the weight and size of these types of prefabricated walls there are issues with shipping and storage. The installation of elements such as electrical, plumbing, and heating and cooling elements requires drilling, threading, blocking or other time consuming methods for installation because there are no channels for the horizontal placement of these systems.

Other systems using prefabricated walls use materials such as metal sheets or poured concrete or cement forms. These types of systems have been unable to overcome the need for skilled tradesmen for installation. Additionally the prefabricated components are heavy and are unable to be installed without the use of specialty equipment such as cranes, lifts, or other heavy mechanical equipment. In addition, many of the systems have been unable to accommodate plumbing, electrical, and HVAC or are make it difficult to install these systems because of the inability to directly install without feeding the systems through complex or small openings. Many of the systems additionally have not been made of materials that help cut costs and reduce the use of non-renewable resources, or are cumbersome and installation is inconvenient and time consuming.

One such system attempted to overcome some of the issues with standard framing techniques: U.S. Pat. No. 6,584,740 and U.S. Pat. No. 5,440,846. However, the system is made with non-renewable materials, doesn't accommodate the electrical, plumbing and HVAC systems in an easy to install manner, and are unable to work with existing structures. The system is designed to be a fully assembled system whereby the users have to use all components of the system in order to develop an entire structure. Thus, the system is unable to be integrated into already developed structures.

Thus, a prefabricated building system made of renewable materials that helps reduce waste, that is easy to install, store and ship is needed. Additionally a prefabricated system that and enables the installation of electrical, plumbing, HVAC, and insulation to be installed vertically and enables easy installation of electrical and plumbing in the horizontal direction without the need for threading, blocking or other time consuming installation issues, has yet to be developed.

SUMMARY

According to various aspects of the present disclosure, there are provided multiple descriptions of the present invention. The present disclosure includes a prefabricated wall segment that is made from materials which are otherwise waste products in the agricultural and forestry industry. The prefabricated building components in the present disclosure are made of natural fast growing plant fibers, such as wood chips or annually re-growing agricultural byproducts or waste products like straw, sorghum grass, corn husks, corn stalks, or corn stover, agave, coconut or bamboo fibers or similar suitable natural fibers. The present system also helps in overcoming the need for waste disposal of these byproducts in their respective industries.

In addition to overcoming the need to utilize the waste associated with the above disclosed industries, utilizing these plant fibers generates a second form of income for farmers and companies in these industries as the byproducts of farming can now be utilized as viable building materials. The use of this abundant waste product allows for the construction of the present invention to be lower in terms of raw materials costs, lower production prices, and higher profit margins for manufactures enabling a delivery of a sustainable product of equal or lower cost than conventional lumber or prefabricated metal structures. These prefabricated structures can be utilized in both new and redesigned structures because of the unique way the prefabricated structures enable all components in modern buildings (electrical, plumbing, and HVAC) to be run through the structures. Additionally, color coded areas which enable the ease of construction and can reduce waste by 10-15% from conventional building methods.

In one embodiment of the present disclosure the trapezoidal design of the system creates a stronger and more resilient and lighter construction. This enhances the ease of installation but also the overall sturdiness to the structure. As a closed system the wall panel system withstands stronger shear, compression and torsion forces while utilizing less material to achieve these enhanced structural properties. The panels are capable of being cut to length so that they can be utilized to build a particular desired sized structure. Additionally windows, doors and other elements can be cut into the structures for installation of these additional elements in construction.

The prefabricated wall panels in one embodiment of the present disclosure are equal or similar to standard building materials in size and thus can be installed by two men, eliminating the need for cranes, advanced delivery systems and installation materials, overcoming some of the obstacles of other prefabricated systems. In one embodiment the system can be mixed with conventional framing techniques and used in concert with conventional tools for installation reducing the need for a set of separately skilled laborers for the installation. Many of the other prefabricated systems, using metal or other materials are unable to accommodate horizontal and vertical installation of electrical, plumbing and HVAC systems. In addition, the way the channels are formed eliminates the need to thread these systems through the preformed panels. Thus, enabling the current invention to partner in both new and existing structures, while reducing time and the need for additional blocking, drilling, fishing, and feeding.

The corrugated core is the main structural element and is generally trapezoidal in design. The corrugated core creates vertical channels running from ceiling to floor in the installed product. The core is a trapezoid design, the vertical channels open alternately toward the interior and exterior of the corrugated core based on the design of the core. In conjunction with outer and inner shear panels these vertical spaces create room for the installation of thermal insulation or the vertical installation of electrical, plumbing and HVAC. A chamber/channel running along each of the sides of the wall panel acts as a location for insertion of connectors and runs vertically between the corrugated core and the external shear panel. This chamber/channel enables multiple prefabricated wall segments to be attached together or for a corner connection to be generated of various angles, 90 degrees being the common angle utilized for standard construction. However, a variety of angles can be developed to accommodate all needs.

On the interior side of the corrugated trapezoidal core are recessed horizontal channels. These horizontal channels provide space for the installation of standard electrical outlets, light switches and other electrical implements, and the horizontal installation of plumbing. The horizontal channels are positioned at standard heights for bottom wall electrical outlets, mid-height wall outlets and switches for general purpose and kitchen counter height, and another for standard upper wall outlets and j-boxes for wall sconces. An interior shear panel is attached to the inside surface of the trapezoidal core by a mechanical fastener such as glue, nails, screws, rivets, or other similar mechanism used independently or with multiple means. Optionally, drywall can be attached over the shear wall panel as in standard framing and construction.

Channel connectors can be inserted between two adjoining prefabricated wall segments. The channel connector is complimentary in shape to the chamber/channel that runs vertically along the sides of the prefabricated wall segment. The channel connectors are the male counterpart to the female chamber/channel. The channel connectors can be fabricated from material similar to the prefabricated wall segments or can be made of other materials such as wood, metal, polymers, plastics, composites, or the like. Channel connectors can have a variety of shapes. In one embodiment the channel connector is comb shaped on either side and each side fits into a similarly shaped chamber/channel. The channel connectors can be simply rectangular in shape, have semicircle protrusions or any other structure similar in nature without departing from the scope of the present disclosure.

A corner can be generated by connecting two units to form an angle at a corner post. Corner posts can be made of standard lumber materials, metal, plastics, or other suitable resources. The corner post is mechanically fastened to each prefabricated wall segment with the additional support of a post cap. The post cap has two legs that are attached to form an angle. Each leg of the post cap has male components similar in shape to the channel connectors and are inserted into the same vertical chambers as the channel connectors. These corner connectors wrap around a standard lumber post which provides structural stability to the connector. In addition to the channel connectors, hold down bolts and hold down brackets are inserted through the corner post and post caps into the prefabricated wall segment from both sides of the corner.

Thermal insulation can be made from various materials offering superior quality. The insulation will be inserted in the outer insulation channels during production prior to the attachment of the outer shear panel. Additionally, insulation can be installed in channels before or after installation of the wall segments by either cutting insulation to fit or using spray or foam type insulation into the core. Insulation also can be installed on the interior opening vertical chambers prior to attachment of the interior shear panel, again either during production or during installation of the prefabricated wall segments. Insulation can also be installed in the exterior opening vertical chambers either before or during installation.

An interior channel brace is located internal to the interior shear panel and is screwed or nailed or fixed by some other similar mechanism into the sides of the core channel in the corrugated core. The channel brace is generally shaped the same as the trapezoidal shape of the corrugated core so as to provide additional integrity to the structure. The channel braces provide additional structural strength where needed, for example for the attachment of a wall connector which runs perpendicular to the main wall segment. It also provides additional mounting surface to which vertical wall rails can be attached by mechanical fasteners such as nails, screws, staples, rivets, glue, or the like, in solo or in combination.

Top plates and bottom plates are attached to the core and run parallel to each other at the top and bottom of the wall segment, respectively. Bottom plates are attached to the floor through mechanical fasteners. Bottom plates have a base and two parallel protrusions running from the base into the corrugated core and the outer shear panel. The bottom plates provide guides for installation of the prefabricated wall segments and provide attachment to the individual segment. The top plates consist of a body and two vertically oriented rails protruding from the body into the corrugated core, mirroring the bottom plates. The vertical protrusions act as guides as well as attachment points for the core and outer shear panel. Wall rails are of similar design as the bottom and top rails and serve as anchor points for the interior walls which run perpendicular or non-parallel to the exterior walls. The wall rails are mounted to the walls vertically by mechanical fasteners such as glue, nails, rivets, screws, or similar equivalent mechanism as previously described.

DRAWINGS

The drawings herein are for illustration purposes only and are not intended to limit the scope of the present disclosure in any way.

FIGS. 5A-5C are a series of multiple versions of the corrugated core.

DETAILED DESCRIPTION

The following description is merely exemplary in nature and is in no way intended to limit the present disclosure, application or uses.

Figure 1:
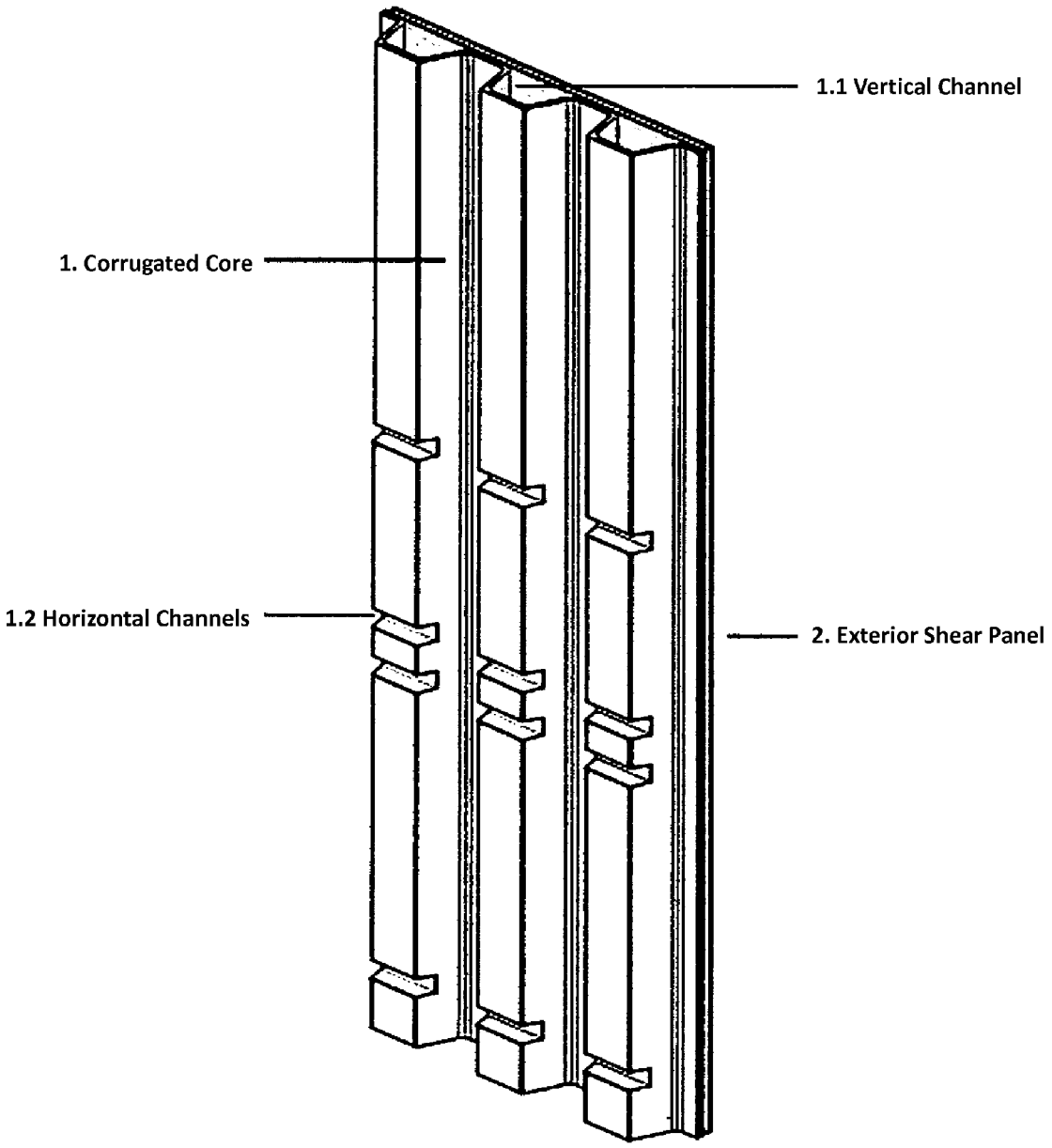
FIG. 1 depicts an isometric inside view of a segment of a wall panel.

FIG. 1 is an exemplary embodiment of an isometric view of the inside of a segment of a wall panel. The cross-section shows the corrugated core 1 which provides vertical channels for installation of insulation, and electrical, plumbing and HVAC systems. Vertical chambers in the corrugated core 1.1 are generally intended for plumbing, electrical, HVAC and insulation. Horizontal channels 1.2 allow for easy installation of electrical, plumbing and HVAC systems in the interior of the structure without the need for threading as with previously designed systems. An exterior shear panel 2 can be cut to accommodate individual widths of each prefabricated panel system and can be connected to adjacent panels at any width. The exterior shear panel is mechanically fixed to the corrugated core by means of mechanical fasteners such as glues, resins, epoxies, nails, screws, rivets, bolts, staples or similarly suitable fastener.

Figure 2:
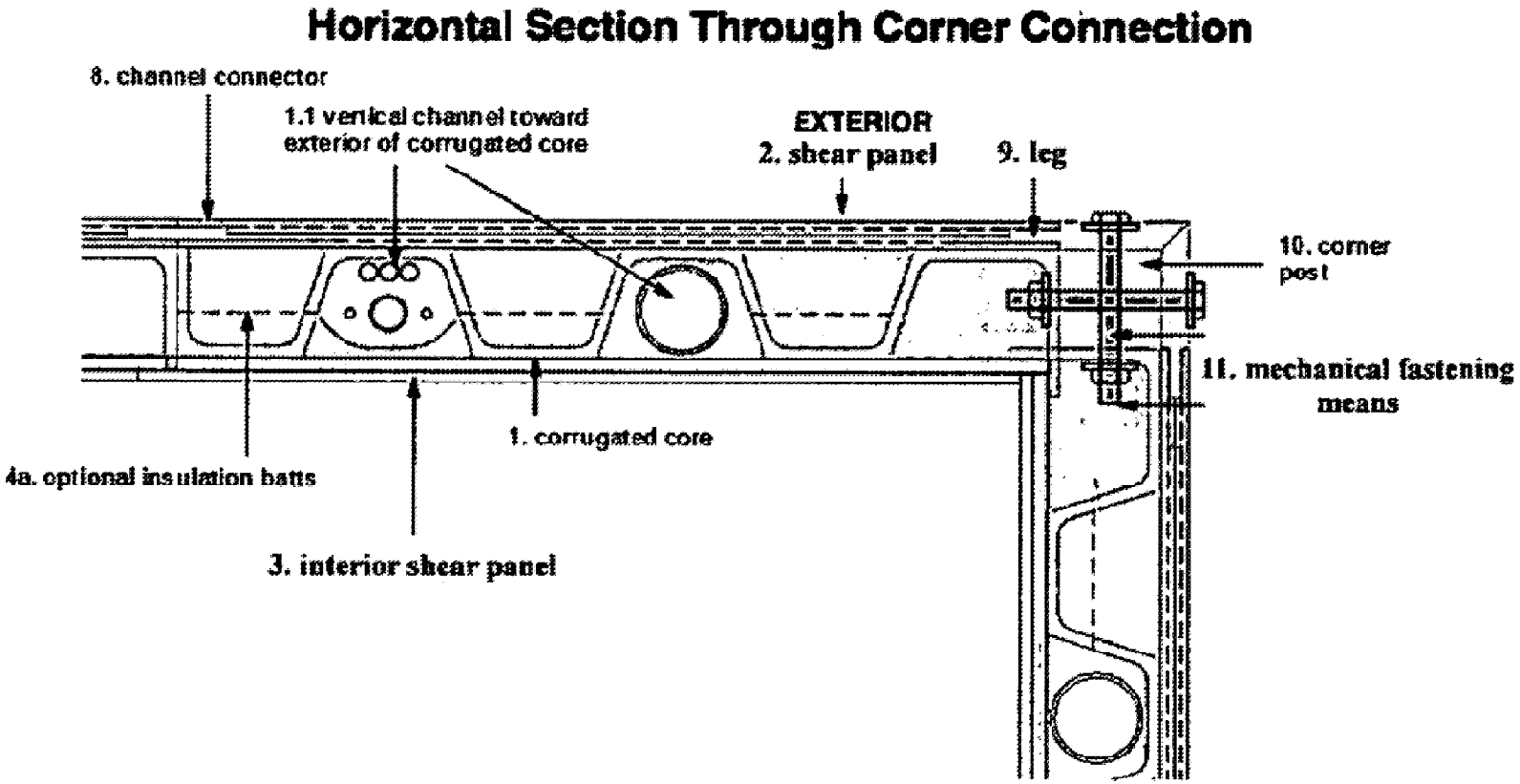
FIG. 2 is a horizontal section through a corner section.

FIG. 2 is an exemplary embodiment of two units connected together forming a corner. The image is a horizontal cross section of the two units joined in the corner by corner post 10 and mechanical fastening means 11. A post cap with legs that extend from either side wraps around the corner post 10 and the leg 9 is a male fitting for the channel/chamber in the exterior shear panel 2. The exterior shear panel 2 can be cut to length and installed after installation of the corrugated core 1. Vertical channels 1.1 run from ceiling to floor through the corrugated core 1 and enable the installation of electrical, plumbing, HVAC and insulation. Insulation batts 4*a* are optionally added in the prefabricated wall segment either before or during installation. A channel connector 8 connects two adjacent prefabricated wall segments together by insertion of opposing two male ends into adjacent hollow chambers/channels running along either the left or the right side of the segment.

Figure 3:
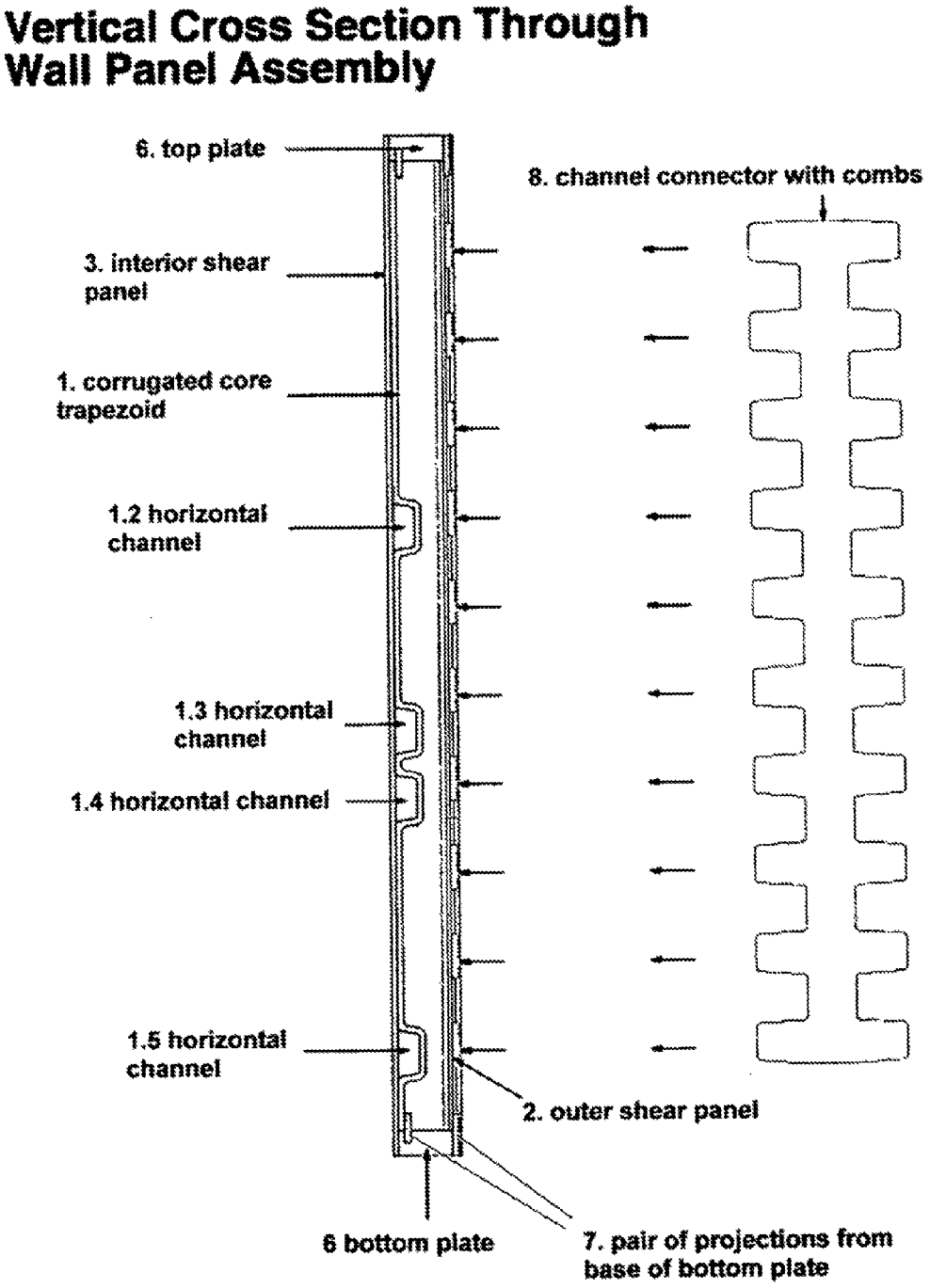
FIG. 3 is a vertical cross section of a wall segment assembly.

FIG. 3 is a vertical cross section of a prefabricated wall segment assembled. A top plate 6 is attached at the top of the segment and has two parallel protrusions extending from the body into the corrugated core 1 and the exterior shear panel 2. The top plate is attached to the corrugated core by mechanical fastening means. The bottom plate 6 mirrors the top plate and is attached to the floor and the corrugated core by mechanical fastening means. The bottom plate 6 consists of a base and two parallel protrusions 7 extending from the base into the corrugated core 1 and the exterior shear panel 2. The bottom plate 6 acts as a guide for the installation of the wall segment. Four series of horizontal channels 1.2, 1.3, 1.4, and 1.5 are provided for horizontal installation of electrical components such as (j-boxes and wall sconces), (plumbing and electrical switches and outlets), and (plumbing and electrical switches and outlets at countertop height), and (plumbing and electrical wall outlets), respectively. These horizontal channels enable installation without the need for complex threading, looping, lacing or time consuming measures needs. A channel connector 8 is inserted in the chamber/channel on either side of two adjacent wall segments. The channel connector 8 can have combs on either side or can have any variety of different shapes which are able to be inserted into the chamber/channel.

Figure 4:
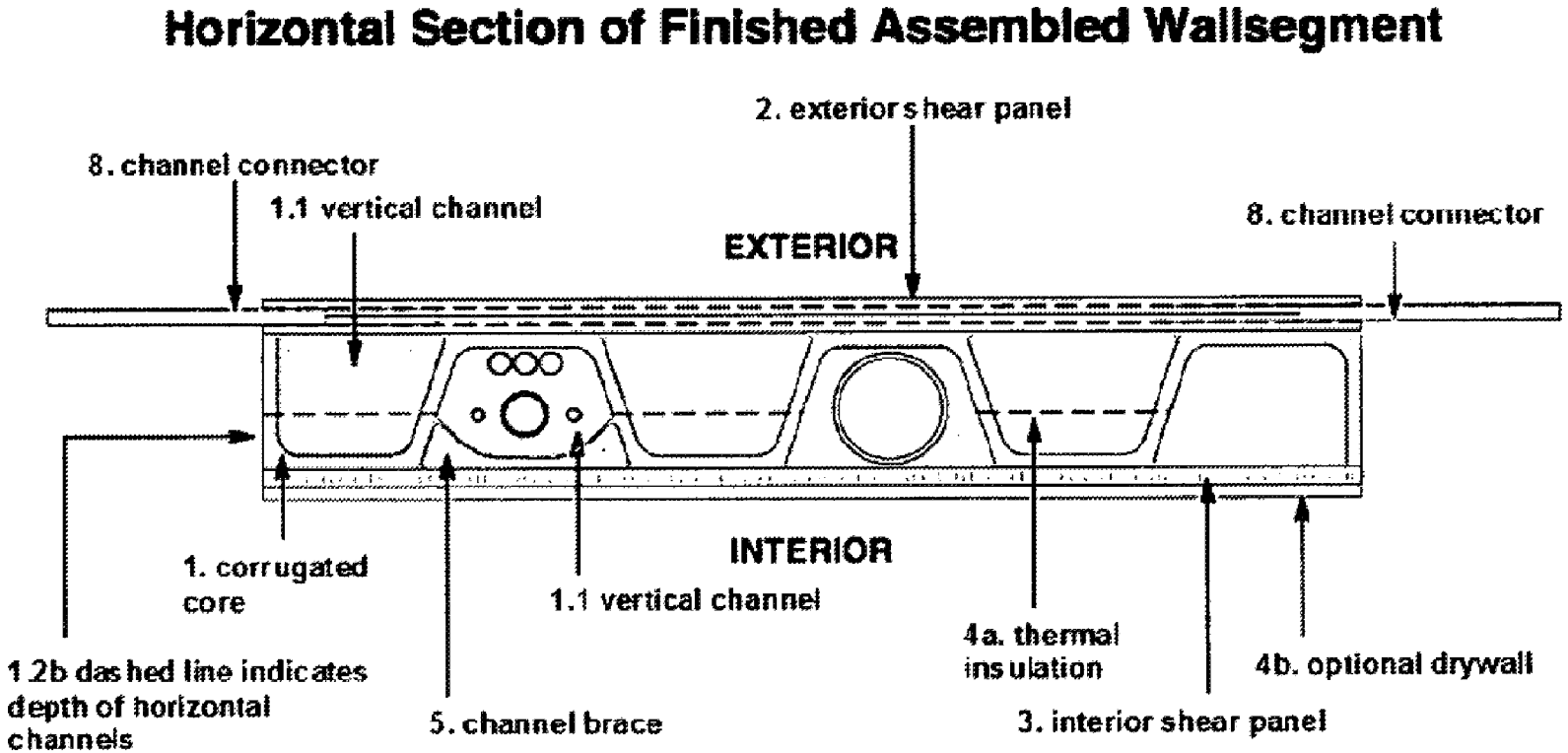
FIG. 4 is a horizontal section of a finished assembled wall segment.

FIG. 4 is a horizontal section of a finished assembled prefabricated wall segment. The corrugated core 1 is the main component of the segment. The corrugated core 1 enables attachment of both an interior shear wall panel and an exterior shear wall panel 2. Channel connectors 8 enable connection of two adjacent wall segments and the male component to the female fitting found in the exterior shear panel 2 located on each side of the wall segment.

The dashed line 1.2*b* in FIG. 4 shows the depth of the horizontal channels for the installation of electrical and plumbing implements at various heights along the corrugated core 1 (heights predetermined following standard design rules and outlet heights). In addition to the horizontal channels 1.2, 1.3, 1.4, and 1.5, vertical channels 1.1 show locations for installation of electrical, plumbing, HVAC and insulation (optional) 4*a* during installation of the wall segments. The exterior shear panel 2 and interior shear panel 3 are installed after and can be cut to various dimensions depending on the size of the corrugated core 1.

FIG. 4 demonstrates that drywall 4*b* also can be installed against the interior shear panel 3 during installation. Because of the unique design of the prefabricated wall segments the segments can work with existing structures which may are may not have drywall or other commonly used surface treatments such as plaster.

Channel braces 5 seen in FIG. 4 can be installed at various locations within the corrugated core 1 and are generally complimentary in shape and size to the trapezoidal structure of the corrugated core. Channel braces 5 add additional strength where needed and are mechanically fixed in place by screws, bolts, nails, glue, epoxy, resins, or similar mechanical means.

FIG. 5 shows three optional versions for the structure of the corrugated core. V1 is a corrugated core with an outer shear panel attached to the solid composite corrugated core with a top joint for attaching multiple panels together (corrugated core with lap joint). V2 shows another embodiment of the present invention where two corrugated trapezoidal cores are buttressed up together so that the interior portion of the corrugated core creates a honeycomb or hexagonal shape (double-sided corrugated core). The interior and exterior shear panels are attached separately. V3 shows a third embodiment of the trapezoidal corrugated core. In between each of the vertical channels in the exterior portion of the core are channel braces for added support (corrugated core with channel braces). This particular method could be inverted and the channel braces would be buttressed up against the interior shear panel as an alternative design. The exterior and interior shear panels would be attached separately.

Figure 6A:
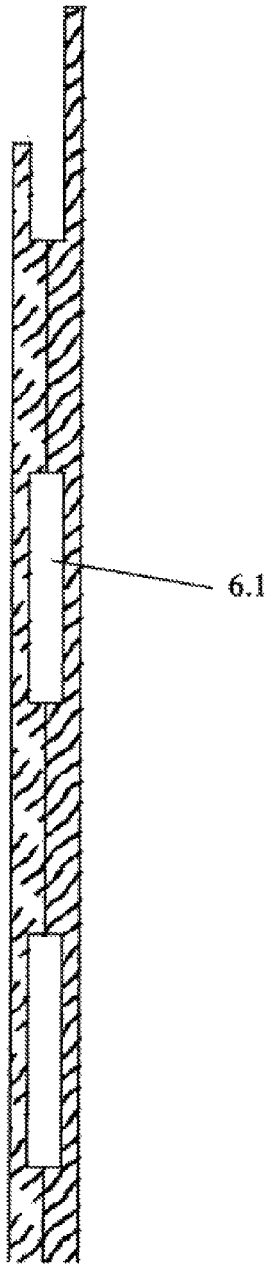
FIGS. 6A & 6B are a cross-sectional side view and a perspective view, respectively, of the outer shear panel.
Figure 6B:
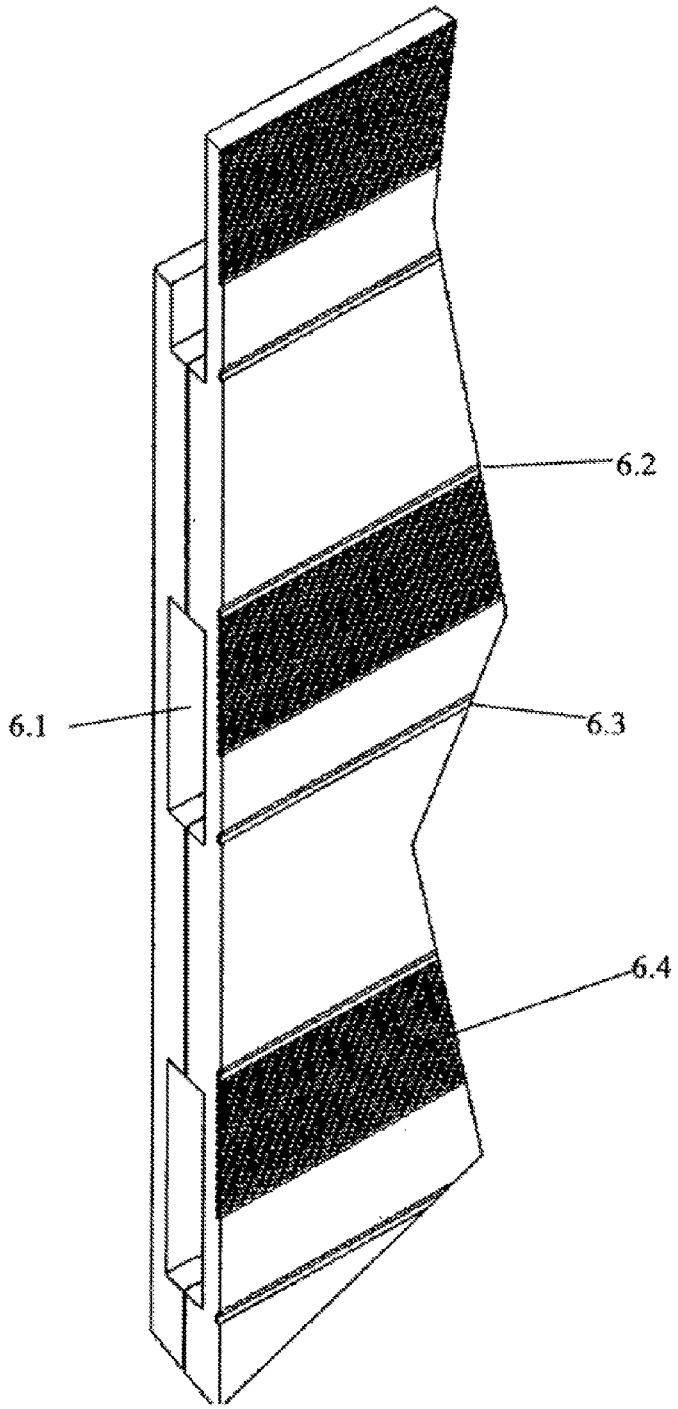

FIG. 6 depicts an isometric section of the outer shear panel. Shadowed areas 6.4 define predetermined areas of the outer shear panel where the panel can be cut to allow for different wall heights. The shadowed areas allow for various cutting heights while still providing enough overlap to enable the male component of the channel connector to insert into the channel connector chamber. 6.2 and 6.3, respectively, define the lowest point on a horizontal portion of a wall segment where the panels can be cut and still provide enough overlap for the insertion of the top plate. Portions of the wall can be color coded by adding dye to the plant fibers to enable easier attachment of different elements of the prefabricated construction system. 6*a* is a cross sectional view of the section of the panel in 6*b*. 6.4 defines an area where the wall segment can be cut to at any given area within this portion and still allow for connection of the top plate. 6.1 defines the chamber for the insertion of the male component of the channel connector.

Figure 7:
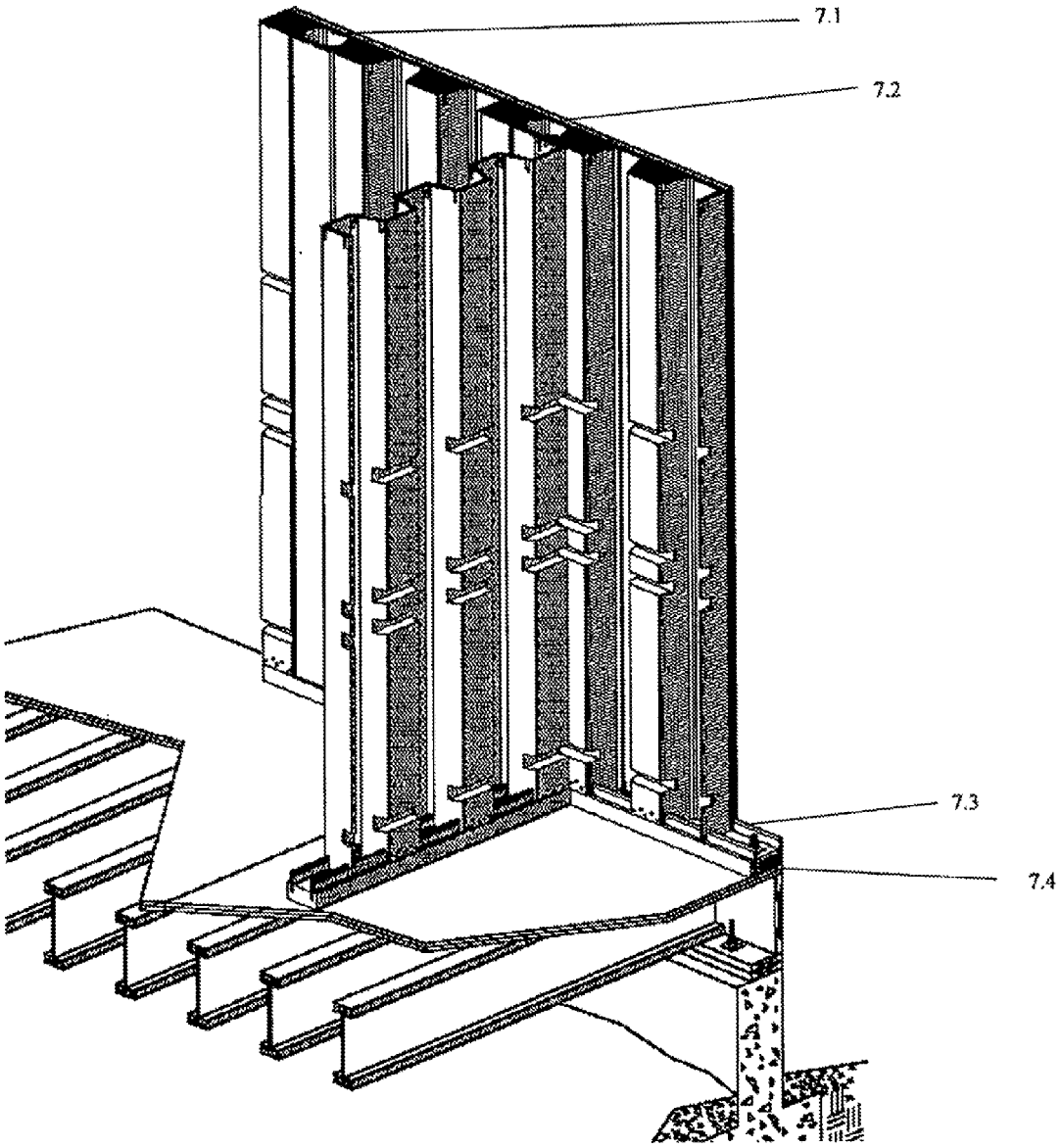
FIG. 7 is a perspective view of multiple panels connected to form interior and exterior walls.

FIG. 7 depicts an interior wall generated by connecting multiple wall segments together 7.2 at an angle. Thus plumbing, electrical and all other building components can be run throughout the wall segments and into the interior spaces of the building. Additional support can be provided by connecting an interior channel brace 7.1 into the vertical spaces in the wall segment. Bottom plates 7.3 are attached to the wall segments and to the subfloor 7.4.

Figure 8:
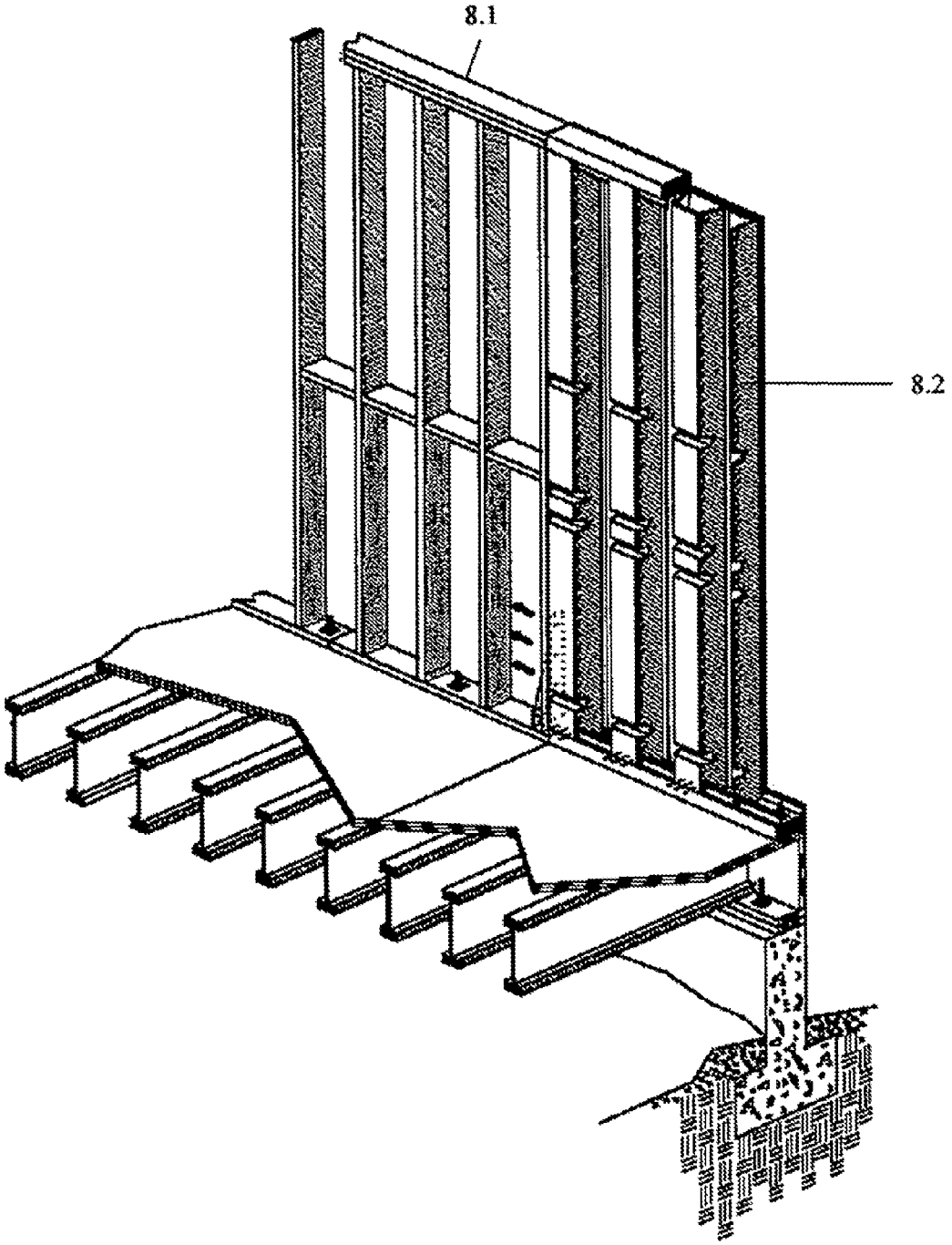
FIG. 8 is a perspective view of a prefabricated panel connected to standard framing.

FIG. 8 depicts a portion of a prefabricated wall segment 8.2 connected to standard stud house framing 8.1.

What is claimed is:

1. A wall system for construction of a building, comprising:

a corrugated core, the corrugated core comprising a series of vertical channels that run parallel to each other, the series of vertical channels are alternately open to an exterior side and an interior side of the corrugated core and define a set of vertical surfaces with a set of vertical spaces between the vertical surfaces on the interior side of the corrugated core, the corrugated core having a top and a bottom and a first end and a second end, wherein the interior side of the corrugated core is further comprised of a set of horizontal channel segments recessed from the set of vertical surfaces, wherein the horizontal channel segments are open to the interior side of the corrugated core and closed to the exterior side of the corrugated core, wherein each one of the vertical surfaces on the interior side between the first end and the second end of the corrugated core has a respective one of the recessed horizontal channel segments, and wherein each one of the horizontal channel segments has a horizontal channel depth relative to the interior side, wherein the horizontal channel depth of the horizontal channel segments is less than a thickness of the corrugated core between the exterior side and the interior side;

an outer shear panel attached to the corrugated core on the exterior side and covering the vertical channels open to the exterior side; and an inner panel attached to the vertical surfaces on the interior side of the corrugated core and covering the vertical channels and the horizontal channel segments open to the interior side.

2. The wall system of claim 1, further comprising a pair of adjacent corrugated cores, a pair of adjacent outer shear panels attached to the respective pair of corrugated cores, a chamber between the adjacent outer shear panels, and a channel connector located in the chamber and connecting the adjacent outer shear panels, wherein the chamber is formed by a pair of adjacent vertical hollow spaces in adjacent sides of the respective adjacent outer shear panels, wherein the channel connector is complimentary in shape and size to the chamber, and wherein each one of the adjacent corrugated cores comprises the vertical surfaces with the respective horizontal channel segments recessed to a horizontal channel depth.

3. The wall system of system of claim 1, wherein each one of the horizontal channel segments is located at a predetermined height relative to at least one of the bottom and the top of the corrugated core.

4. The wall system of claim 3, wherein the corrugated core has a first thickness in a first horizontal cross-section proximate to at least one of the top and the bottom of the corrugated core and has a second thickness in a second horizontal cross-section through the horizontal channel segments, wherein the first thickness is equal to the thickness of the corrugated core and wherein the second thickness is less than the first thickness.

5. The wall system of claim 4 further comprising an interior channel brace mechanically attached to the corrugated core, wherein the interior channel brace is complimentary in shape to the corrugated core.

6. The wall system of claim 1 further comprising a top plate mechanically fixed to the top of the corrugated core, the top plate having a body and a pair of downward facing parallel protrusions vertically extending from the body toward the corrugated core and toward the outer shear panel, one of the pair of downward facing parallel protrusions extends into the corrugated core and one of the pair of downward facing parallel protrusions extends into the outer shear panel, a bottom plate is mechanically fixed to the bottom of the corrugated core, the bottom plate having a base and a pair of upward facing parallel protrusions extending from the base toward the corrugated core and toward the outer shear panel, one of the pair of upward facing parallel protrusions extends into the corrugated core and one of the pair of upward facing parallel protrusions extends into the outer shear panel.

7. The wall system of claim 1, wherein the inner panel is a shear panel, wherein the outer shear panel is further comprised of a series of vertically-spaced horizontal chambers extending horizontally through an entire width of the outer shear panel, and wherein the corrugated core is selected from the group of corrugated shapes consisting of a corrugated core with a lap joint, a double-sided corrugated core, and a corrugated core with channel braces.

8. The wall system of claim 7, further comprising a connector and a pair of adjacent outer shear panels, wherein at least one of the sides of the adjacent outer shear panels comprises a vertical hollow space, wherein each one of the outer shear panels is further comprised of the vertically-spaced horizontal chambers, wherein the connector has a center section fitting within the vertical hollow space and a plurality of vertically-spaced horizontal protrusions corresponding with and extending into the vertically-spaced horizontal chambers in the adjacent outer shear panels.

9. The wall system of claim 8, wherein one of the adjacent sides of the adjacent outer shear panels is cut to a desired width and another one of the adjacent sides of the adjacent outer shear panels is uncut, and wherein the center section of the connector fits in the vertical hollow space of the uncut one of the adjacent sides and the vertically-spaced horizontal protrusions extend into the vertically-spaced horizontal chambers in the adjacent outer shear panels.

10. The wall system of claim 1, further comprising a pair of adjacent corrugated cores, wherein the adjacent corrugated cores have a respective pair of adjacent vertical channels, wherein each of the adjacent vertical channels comprises a vertical surface and a horizontal channel segment recessed from the vertical surface.

11. The wall system of claim 1, further comprising at least one of electrical and plumbing components fitting between the horizontal channel segments and the inner panel and extending through the set of horizontal channel segments and corresponding set of vertical spaces from the first end of the corrugated core to the second end of the corrugated core.

12. The wall system of claim 1, wherein the outer shear panel is comprised of natural fibers having a color coding for identifying cutting heights.

13. The wall system of claim 1, wherein the set of horizontal channel segments is located at a predetermined height relative to at least one of the bottom and the top of the corrugated core, wherein the predetermined height is selected from the group of fixture heights consisting of a bottom height, a first mid-height for plumbing, a second mid-height for electrical, an upper height and any combination thereof, wherein the set of horizontal channel segments form a horizontal channel extending between the first end and the second end of the corrugated core, the horizontal channel being recessed from the vertical surfaces by the horizontal channel depth at the predetermined height.

14. The wall system of claim 1, further comprising at least one of a channel brace, an outlet, a switch, a j-box, a sconce, and an HVAC fixture, wherein the channel brace is complimentary in shape to at least one of the vertical spaces and covers at least one of the vertical channels, and wherein the outlet is selected from the group of fixtures consisting of an electrical outlet and plumbing outlet, and wherein the switch is selected from the group of fixtures consisting of electrical switches and plumbing switches and is installed in at least one of the vertical spaces.

15. A wall system for construction of a building comprising:

a first corrugated core comprising a first series of vertical channels and a first set of horizontal channel segments, the first corrugated core further comprising a first pair of ends, wherein the first series of vertical channels are comprised of a first set of vertical spaces separated by a first set of vertical surfaces, wherein each one of the first set of vertical surfaces has a corresponding one of the first set of horizontal channel segments recessed to a first horizontal channel depth within the first series of vertical channels;

a second corrugated core comprising a second series of vertical channels and a second set of horizontal channel segments, the second corrugated core further comprising a second pair of ends, wherein the second series of vertical channels are comprised of a second set of vertical spaces separated by a second set of vertical surfaces, wherein each one of the second set of vertical surfaces has a corresponding one of the second set of horizontal channel segments recessed to a second horizontal channel depth within the second series of vertical channels, wherein the second horizontal channel depth has a same depth as the first horizontal channel depth, and wherein the same depth of the first horizontal channel depth and the second horizontal channel depth is less than a thickness of the first corrugated core and the second corrugated core; and a means for connecting one of the first pair of ends of the first corrugated core to one of the second pair of ends of the second corrugated core, wherein the first set of horizontal channel segments and the second set of horizontal channel segments each have an end horizontal channel segment adjacent to each other at a predetermined height.

16. The wall system of claim 15, wherein the connecting means is comprised of at least one of a top plate, a bottom plate, a wall rail, a channel connector between a pair of adjacent outer shear panels, and a corner post.

17. The wall system of claim 15, wherein the first corrugated core and the second corrugated core each have a top and a bottom, and wherein the first and second set of horizontal channel segments are located at a same predetermined height relative to at least one of the top and the bottom of the first corrugated core and the second corrugated core.

18. The wall system of claim 15, further comprising at least one of electrical and plumbing components running through the first set and second set of horizontal channel segments and extending across the first pair of ends in the first corrugated core to the second pair of ends in the second corrugated core.

19. The wall system of claim 15, further comprising a first inner panel attached to the first set of vertical surfaces and a second inner panel attached to the second set of vertical surfaces, wherein the first inner panel and second inner panel cover the vertical channels and the horizontal channel segments.

20. An improved wall system for construction of a building having a corrugated core and at least one panel fastened to and covering an interior side of the corrugated core, the corrugated core having a width and comprising a plurality of vertical channels having a thickness, the covered interior side of the corrugated core being formed by a series of alternating vertical surfaces and vertical spaces, wherein the vertical surfaces are adjacent to the panel, the improvement comprising:

a horizontal channel formed in the corrugated core by a plurality of horizontal channel segments recessed into the interior side of the corrugated core, wherein the horizontal channel spans the entire width of the corrugated core in that the horizontal channel segments are recessed into at least one side of each one of the vertical surfaces, wherein the horizontal channel is open to the interior side of the corrugated core, closed to the exterior side of the corrugated core and covered by the panel, wherein the horizontal channel has a horizontal channel depth that is less than the thickness of the vertical channels at each one of the horizontal channel segments where the horizontal channel intersects the vertical surfaces adjacent to the panel.

21. The improved wall system of claim 20 further comprising a plurality of horizontal channels located at varying heights relative to at least one of a bottom and a top of the corrugated core, wherein the horizontal channels intersect with and connect the vertical spaces between the vertical channels formed in the corrugated core, wherein at least one of plumbing pipes and electrical lines are run across the vertical channels through at least one of the horizontal channels between the corrugated core and the panel.

22. The improved wall system of claim 20, further comprising at least one of a channel brace, an outlet, a switch, a j-box, a sconce, and an HVAC fixture, wherein the channel brace is complimentary in shape to one of the vertical spaces and covers at least one of the vertical channels, wherein the outlet is selected from the group of fixtures consisting of an electrical outlet and plumbing outlet, and wherein the switch is selected from the group of fixtures consisting of electrical switches and plumbing switches and is installed in at least one of the vertical spaces.

23. The improved wall system of claim 20, further comprising an outer shear panel attached to the corrugated core on the exterior side and covering the vertical channels open to the exterior side.

* * * * *